US006951087B2

(12) United States Patent
Weurman

(10) Patent No.: US 6,951,087 B2
(45) Date of Patent: Oct. 4, 2005

(54) PANEL MOUNTING SYSTEM FOR CONSTRUCTING A WALL

(75) Inventor: Kees Hans Weurman, Kaulille (BE)

(73) Assignee: Trespa International B.V., Weert (NL)

( * ) Notice: Subject to any disclaimer, the term of this patent is extended or adjusted under 35 U.S.C. 154(b) by 84 days.

(21) Appl. No.: 10/317,291

(22) Filed: Dec. 11, 2002

(65) Prior Publication Data

US 2003/0115818 A1 Jun. 26, 2003

(30) Foreign Application Priority Data

Dec. 21, 2001 (DE) ..... 101 63 508

(51) Int. Cl.[7] ..... E04B 2/32; E04C 2/34

(52) U.S. Cl. ..... 52/489.2; 52/489.1; 52/481.1; 52/508

(58) Field of Search ..... 52/481.1, 481.2, 52/489.1, 508, 511, 512, 489.2

(56) References Cited

U.S. PATENT DOCUMENTS

| | | | | | |
|---|---|---|---|---|---|
| 1,998,688 | A | * | 4/1935 | Robinson et al. | 52/241 |
| 3,753,325 | A | * | 8/1973 | Stanley et al. | 52/481.2 |
| 3,998,018 | A | * | 12/1976 | Hodges | 52/481.2 |
| 4,263,764 | A | * | 4/1981 | Wendt | 52/481.2 |
| 5,224,322 | A | * | 7/1993 | van den Toorn | 52/765 |
| 5,555,689 | A | * | 9/1996 | Gilmore | 52/489.1 |
| 5,632,127 | A | * | 5/1997 | Agar et al. | 52/481.2 |
| 5,797,233 | A | * | 8/1998 | Hascall | 52/481.1 |
| 5,950,386 | A | * | 9/1999 | Shipman et al. | 52/481.2 |
| 6,122,867 | A | * | 9/2000 | Leconte | 52/144 |
| 6,178,713 | B1 | | 1/2001 | Delie et al. | 52/506.08 |

FOREIGN PATENT DOCUMENTS

| | | | |
|---|---|---|---|
| DE | 3133978 A1 | * | 3/1983 |
| DE | 3726255 A | * | 1/1989 |
| DE | G 94 16 917.9 | | 1/1995 |
| DE | 0 761 904 A1 | | 3/1997 |
| DE | 0 921 253 A2 | | 6/1999 |
| FR | 2451486 A | * | 11/1980 |
| JP | 8199931 A | * | 8/1996 |

* cited by examiner

*Primary Examiner*—Anita King
*Assistant Examiner*—Jon Szumny
(74) *Attorney, Agent, or Firm*—Roberts & Roberts, LLP

(57) ABSTRACT

The mounting system comprises a grid of vertically upright C-profiles which are pushed with their lower and upper ends into horizontally extending U-profiles. Bracket clips are fitted to outer sides of the mutually opposite legs of the C-profiles. The bracket clips on the profiles are in engagement with rails. Panels are fastened to these rails. An insulating material can be accommodated in the gap enclosed by the panels.

19 Claims, 4 Drawing Sheets

PANEL MOUNTING SYSTEM FOR CONSTRUCTING A WALL

BACKGROUND OF THE INVENTION

1. Field of the Invention

The invention relates to a panel mounting system for constructing a wall, comprising a grid of vertically upright C-profiles which are pushed with their lower and upper ends into in each case a horizontally extending U-profile.

2. Description of the Related Art

EP-A 0 761 904 describes a mounting system for panels for facade cladding on buildings. The mounting system comprises profiles and U-shaped hooks which are connected by means of a fastening element to the panel side which faces a building wall. Angle profiles are fastened to the building wall, the longer angle sides of these profiles projecting into the space between side walls of the hook and having punched openings. Bolts, which are fixed in their position in relation to the respective hook, are pushed through holes in the side walls and through the punched openings.

From German Utility Model G 94 16 917.9, a fastening system for compact panels is known, which consists of one or more fiber layers which are hot-pressed together with one another and impregnated with resin and are coated externally on at least one side with a decorative layer. The fastening system makes it possible to mount the compact panels on a basic body, the mounting elements not being visible from outside. The fastening system comprises a profile which interconnects the compact panels and a wall or a basic body, and milled cuts are made in those sides of the compact panels facing the basic body, the cross sections of which milled cuts coincide with portions of the profile.

The core of compact panels has very great strength and can therefore take up great forces without breaking or being deformed. Compact panels or similar panels are used in particular for facade and wall claddings on account of their great weathering resistance and dimensional stability, care being taken that the fastening of the panels to a wall or a basic body is invisible from the outside. According to the state of the art, invisible fastening is brought about by the panels being adhesively bonded or fastened by means of screws. In the case of screw connections, these are made directly to the panels, dowels generally being present in the panels, into which the screws are screwed. Connection to the wall lying behind or to the basic body located behind is effected via, for example, brackets.

From EP-A 0 921 253, a mounting system is known, which consists of basic profiles and connecting profiles which are fastened horizontally to vertical profiles. The vertical profiles are connected to a building wall. Each basic profile has a U-like cross section, in which the upwardly directed leg further away from the building wall is shorter than the leg fastened to the vertical profiles. Each connecting profile has a short, upwardly and downwardly directed leg which is further away from the building wall than a vertical leg which is connected to the vertical profiles. Adjoining the lower end of the vertical leg is a horizontal leg which has a flexible elastic insert at its open end.

According to the state of the art, it is usual to fasten metal hooks in a hole on the rear side of the panels using screws or dowels. The panels are then suspended in metal rails fastened in vertical profiles connected to the wall or to the building. Mounting systems are used not only for facade cladding of building walls with panels but also for erecting partitions which, for example, subdivide a large space into a number of smaller spaces. The panels used for such walls are preferably compact panels and high-pressure laminate panels, but also prefabricated plaster panels, plasterboard panels and similar panels, which are fastened to both sides of a grid-shaped mounting system. By means of such mounting systems, walls are created which have a cavity and the thicknesses of which are predetermined by the dimensions of the mounting system. In the event of such walls being required to provide acoustic insulation according to the standards, insulation can be introduced into the cavities of these walls.

It is an object of the invention to produce a panel mounting system for a wall, which system makes possible simple and rapid mounting of a wall which can vary in its thickness and has good acoustic insulation according to EN-ISO standards 140-3 (1995) and 717-1 (1996).

This object is achieved by virtue of the fact that bracket clips are fitted to outer sides of the mutually opposite legs of the individual upright C-profiles, that the bracket clips are arranged at the same height on the upright C-profiles and are in engagement with rails, and that panels are fastened to the rails.

In a development of the invention, the bracket clip has a base plate with a rectangular outline, and a claw bent off at a right angle is present at each corner of the base plate. By means of these claws, the bracket clip is fitted to a leg of an individual upright C-profile of the panel mounting system. Additionally, the bracket clip is then screwed to this C-profile by means of a screw.

In one embodiment, the bracket clip has in the base plate a rectangular or square opening, in front of which a bracket is located, which extends parallel to the base plate at a spacing of 1 to 3 mm, the bracket forming, with the base plate, a gap with a gap width corresponding to this spacing and, on its lower side, being connected to the base plate.

In an embodiment of the invention, the bracket is congruent on three sides with the opening, and a clear spacing of 2 to 4 mm exists between an upper edge of the bracket and an upper edge of the opening. At the same time, an upper portion, together with the upper edge of the bracket, extends away from the base plate, bent off obliquely.

Expediently, a slot is present in the base plate below the bracket, through which slot the bracket clip can be fastened to the upright C-profile by means of a screw. In another embodiment, a slot is present above the bracket.

SUMMARY OF THE INVENTION

The invention provides a panel mounting system for constructing a wall, comprising a grid of vertically upright C-profiles having lower and upper ends, which are pushed with their lower and upper ends into a horizontally extending U-profile, wherein bracket clips are fitted to outer sides of mutually opposite legs of each upright C-profile, wherein the bracket clips are arranged at the same height on each upright C-profile and are in engagement with rails, and wherein panels are fastened to the rails.

DETAILED DESCRIPTION OF THE PREFERRED EMBODIMENT

Figure 1B:
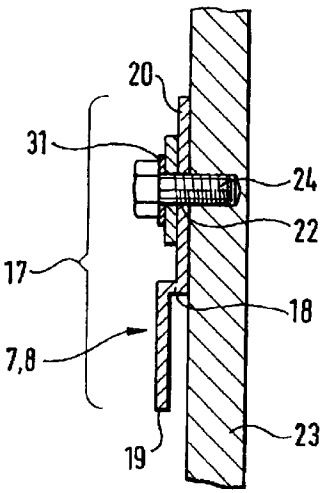
FIG. 1*b* shows partially the fastening of a panel to a rail of the panel mounting system.
Figure 1A:
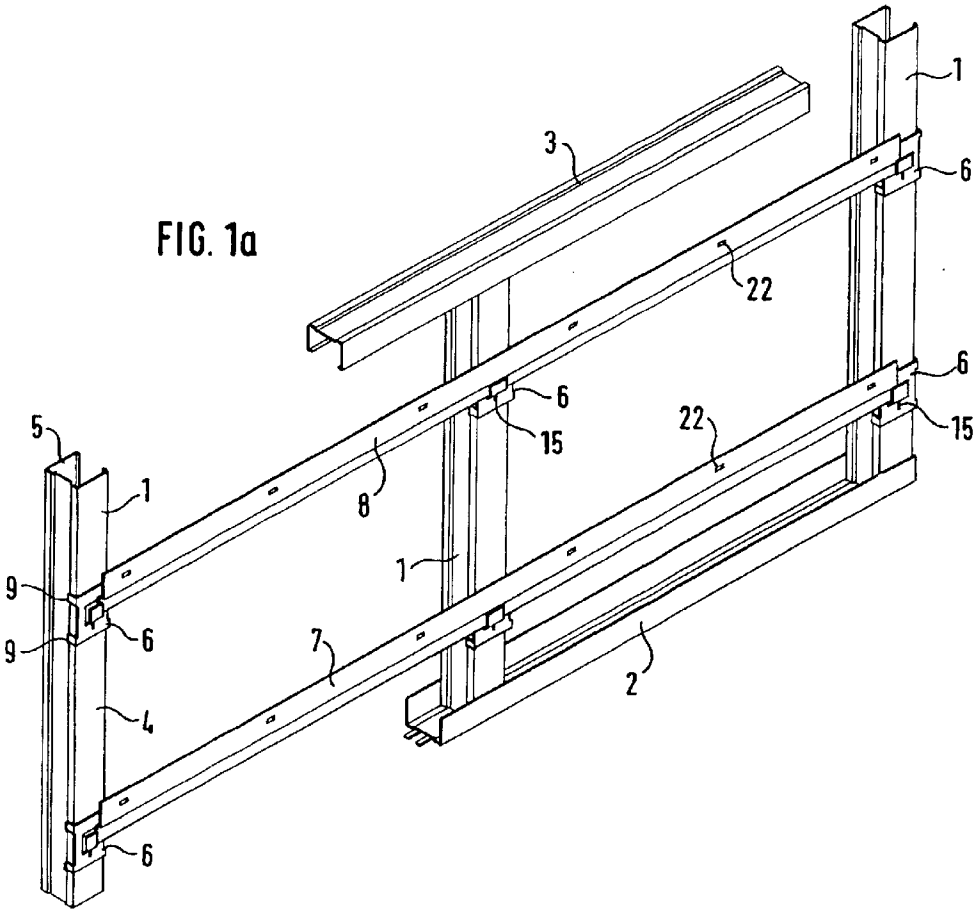
FIG. 1*a* shows a perspective view of a panel mounting system consisting of U profiles, C-profiles, rails and brackets.
Figure 2B:
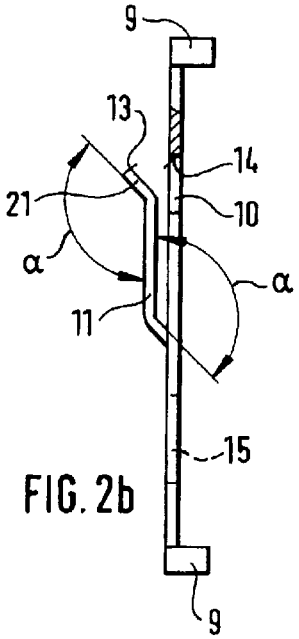
FIGS. 2*a*, 2*b* show a plan view and, respectively, a side view of a first embodiment of a bracket.
Figure 2A:
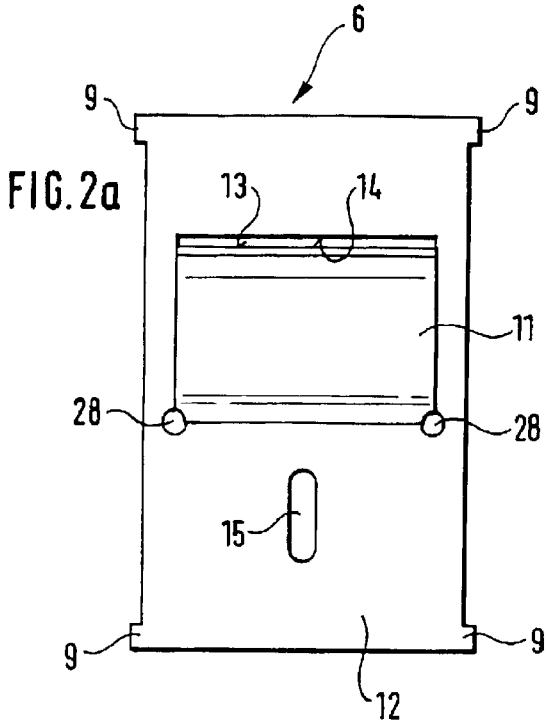

A panel mounting system, which is shown in a perspective view in FIG. 1*a*, comprises a grid of vertically upright C-profiles 1 which are pushed with their lower ends into a horizontally extending U-profile 2. The U-profiles and C-profiles describe the same profile type, and the C-profiles are insertable or pushable into the U-profiles. The C-profiles stand vertically, while the U-profiles are aligned horizontally. The lower horizontal U-profile 2 can, for example, be fastened, in a manner which is not shown, such as on the floor surface of a space. The upper ends of the C-profiles 1 are pushed into an upper horizontally extending U-profile 3. This upper U-profile 3 can likewise be connected, in a manner which is not shown, such as to the ceiling surface of a space. The C-profiles 1 have mutually opposite legs 4, 5 which extend parallel to the outer sides of the panel mounting system. Bracket clips 6 are fitted to the outer sides of the mutually opposite legs 4 and 5 of each individual vertically upright C-profile 1. The individual bracket clip 6 comprises a base plate 12 (see FIG. 2*a*) with a rectangular outline. A claw 9 bent off at right angles is present at each corner of the base plate 12. The claws 9 are directed inwardly from the outer sides of the legs 4 and 5 and surround the side edges of the legs 4 and 5. The bracket clips 6 are arranged on the upright C-profiles at the same height and, as will be described in greater detail below, are fastened to the C-profiles 1. What are known as Z-rails 7, 8, which extend horizontally over the width of the panel mounting system, engage in the bracket clips 6 and make possible the fastening of panels 23 (see FIG. 1*b*) to the panel mounting system. The rails 7, 8 are provided with holes 22, preferably slots, which serve for fastening the panels 23. As can be seen from the detail in FIG. 1*b*, the individual Z-rail 7; 8 has a double-angled profile 17 which comprises an upper profile portion 20, a central profile portion 18 and a lower profile portion 19. The upper and lower profile portions each enclose an angle of 90° with the central profile portion 18, and they project in opposite directions from this central profile portion 18. In this connection, the upper profile portion 20 bears against a rear side of the panel 23 which is screwed onto the rail 7, 8 by means of a screw 24 which extends through the slot 22. A washer 31, for example in the form of a nylon ring, surrounds the screw 24 and is located between the screw head and the upper profile section 20. The lower profile section 19 extends parallel to the rear side of the panel 23 at a spacing which is predetermined by the central profile portion 18. The screws 24 have a length which is, at most, equal to the thickness of the panels 23. This ensures that the fastening of the panels 23 to the rail 7, 8 remains invisible from outside. In FIGS. 2*a* and 2*b*, a bracket clip 6 is shown in plan view and side view, respectively. The bracket clip 6 has in its base plate 12 a rectangular or square opening 10, in front of which a bracket 11 is located. With the base plate 12, the bracket 11 forms a gap, having a gap width of from about 1 mm to about 3 mm and is connected on its lower side to the base plate 12. At the corners of the lower edge of the opening 10, a borehole 28 is in each case located on the left and the right. The bracket 11 extends parallel to the base plate 12 at a spacing of from about 1 to about 3 mm and is congruent on three sides with the opening 10. A clear spacing of from about 2 to about 4 mm exists between an upper edge 13 of the bracket 11 and an upper edge 14 of the opening 10. Together with the upper edge 13 of the bracket 11, an upper portion 21 of the bracket 11 (see FIG. 2*b*) is bent off obliquely upwardly away from the base plate 12. The angle between this obliquely upwardly facing, bent-off upper portion 21 and the base plate 12 of the bracket 11 preferably ranges from about 135° to about 160°. The thickness of the material for the bracket clip 6 preferably ranges from about 1.2 to about 1.8 mm. The claws 9 at the corners of the base plate 12 of the bracket clip 6 are bent backward in FIG. 2*a*. A slot 15 is located below the bracket 11. The bracket clip 6 is produced by the boreholes 28 being made first and the outlines of the opening 10 then being cut into the base plate 12. Subsequently, the bracket 11 is formed by corresponding bending off of the cut material. In addition, the slot 15 below the bracket 11 is milled out, and the claws 9 at the corners of the base plate 12 are bent backward. The slot 15 serves for screwing the bracket clip 6 together with the C-profile 1.

Figure 3B:
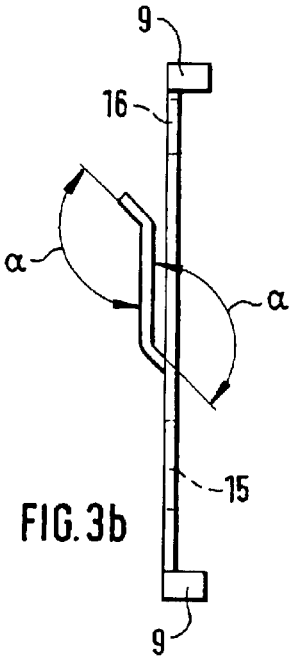
FIGS. 3*a*, 3*b* show a plan view and a side view of a second embodiment of a bracket.
Figure 3A:
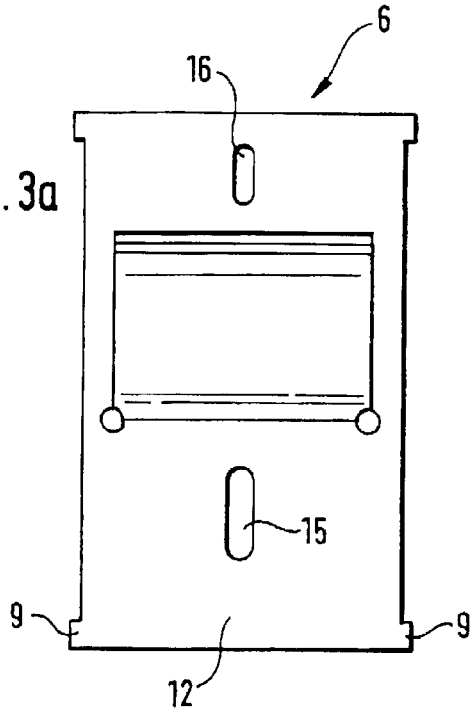

In FIGS. 3*a* and 3*b*, a further embodiment of the bracket clip 6 is illustrated in a plan view and, respectively, side view. This bracket clip 6 is constructed substantially identically to the bracket clip according to FIGS. 2*a* and 2*b* and additionally has only a further slot 16 which is located above the bracket 11. This bracket clip 6 is preferably fastened to the C-profile 1 with a countersunk screw. A plane head surface of the countersunk screw aligns with the outer side of the base plate 12, so that the Z-rail 7, 8 can be brought into engagement with the bracket clip 6 without problems. The other parts of this bracket clip 6 correspond substantially to the corresponding parts of the bracket clip 6 of the first embodiment.

The lower profile portion 19 of the rail 7, 8 engages in the gap between the bracket 11 and the base plate 12 of the bracket clip 6.

The grid of vertically upright C-profiles 1 is, for example, covered over its area on both sides with the panels 23. Mounting is carried out by the rails 7, 8 being screwed together with the rear sides of the panels 23 via the slots 22. After this has been done, the surface comprising mutually abutting panels is mounted on the vertically upright C-profiles by the lower profile portions 19 engaging in the bracket clips 6 which are fastened to the C-profiles 1. In the same way, a further surface is then formed from the rails 7 and 8 and panels 23, which is then connected to the panel mounting system by the lower profile portions 19 of the rails 7, 8 once again engaging in the corresponding bracket clips 6. In this way, the two surfaces comprising panels 23, which surfaces are connected to the panel mounting system, form a wall 25 of predetermined wall thickness. The cavity of this wall, i.e. the space between the two surfaces formed from panels, is preferably, for example, fully or partly acoustically insulated with insulating material 27. In another embodiment, this cavity may be free of insulating material. Suitable materials for the insulating material 27 nonexclusively include mineral wool, glass wool, or similar materials.

Figure 4A:
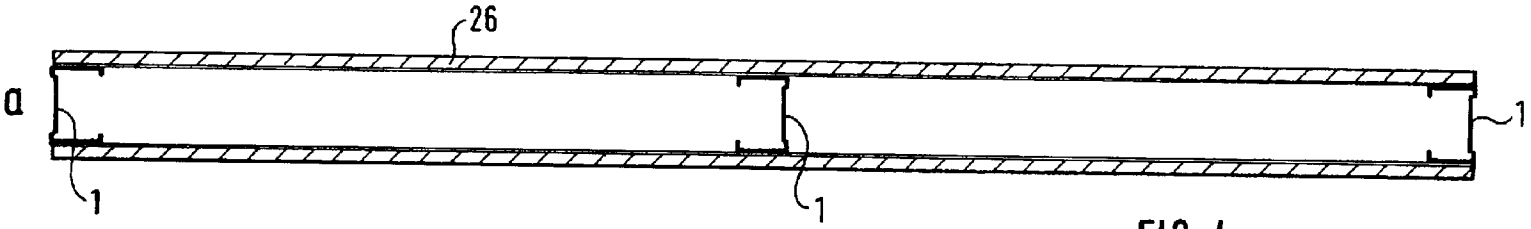
FIG. 4 shows three differently insulated walls a to c in cross section, which are constructed from panels fastened to the panel mounting system.
Figure 4B:
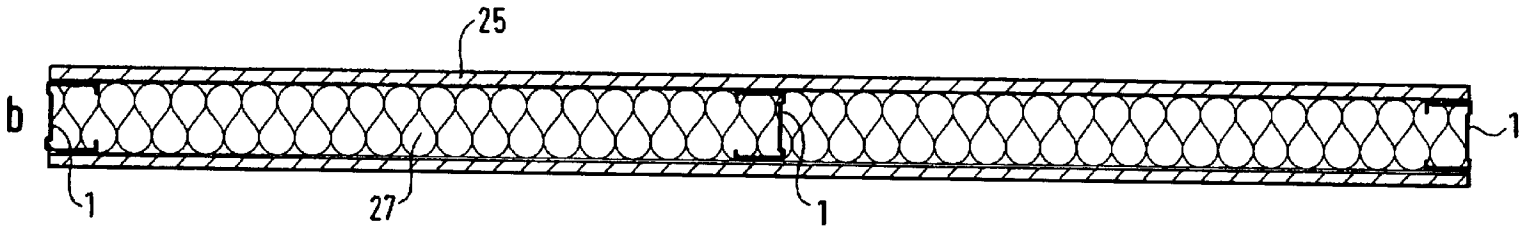
Figure 4C:
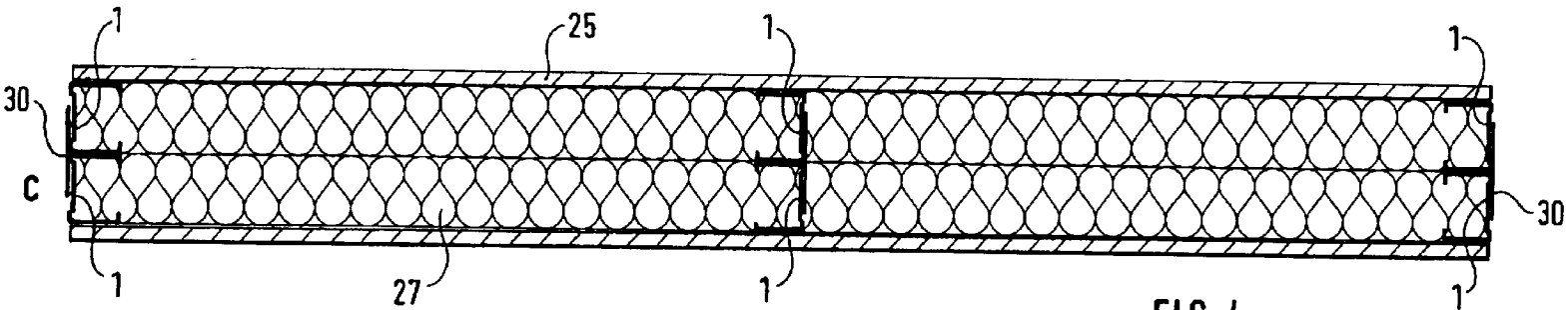

In FIG. 4, three differently constructed walls "a" through "c" are illustrated diagrammatically in cross section. Wall "a" is, for example, a wall 26 with no insulating material present in its cavity. The walls 25 of embodiments "b" and "c" are each walls with insulating material 27 located in their cavities. Embodiments "a" and "b" have the same wall thickness, the wall 25 according to embodiment "b" having a cavity completely filled with insulating material 27. The panels used for the walls 25 and 26 are, for example, compact panels or high-pressure laminated panels with a thickness of about 10 mm.

Embodiment "c" is twice as thick as embodiments "a" and "b", and the cavity between the outer surfaces is completely filled with insulating material 27. In embodiment "c", two C-profiles 1 are present, lying against one another. The panel thickness of the compact or high-pressure laminate panels is, for example, about 10 mm. The two C-profiles are, for example, held together by connecting elements 30, but can also be designed in such a way that connecting elements are not necessary.

Acoustic tests were carried out with the walls, which have a construction according to embodiments "a" through "c" in FIG. 4. Each individual test wall had an area of about 12 $m^2$ (4297×2796 mm) and an overall wall thickness of about 95 mm and, respectively, about 190 mm and was exposed to acoustic irradiation with a frequency in the range from about 125 Hz to about 4 kHz in an acoustic irradiation volume of about 205 $m^3$, the transmitting space having a volume of about 111 $m^3$ and the receiving space a volume of about 94 $m^3$. The measurement curves obtained were compared with reference curves according to EN-ISO standard 717-1 (1996). The damping in dB was plotted as a function of frequency. Two measurement curves were recorded per test wall. The ⅓ octave bandwidth was ⅓ of the frequency range from about 125 Hz to about 4 kHz. The measurement curves for the ⅓ octave bandwidths are shown by solid lines in FIG. 5, while the curves for the mean value consisting of three measurements, each measurement having been carried out over the full ⅟₁ octave bandwidth, are indicated by stars.

Figure 5:
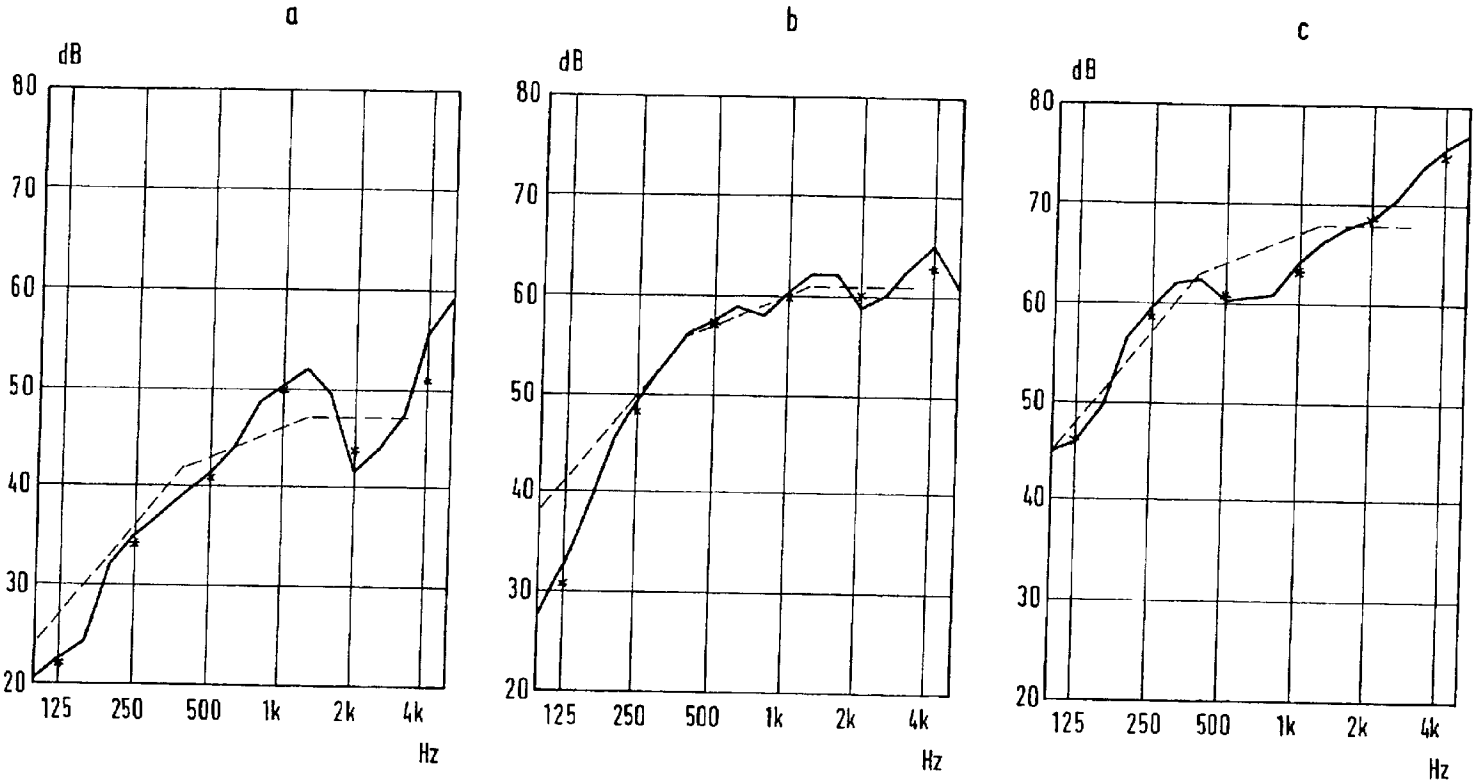
FIG. 5 shows in comparison the acoustic insulation of the walls according to FIG. 4 as a function of the acoustic irradiation frequency.

The reference curves according to EN-ISO standard 717-1(1996) for each individual test wall "a" through "c" are illustrated by broken lines in FIG. 5.

In Table 1 below, the acoustic damping values in dB are in each case compiled as a function of frequency for the test walls, the ⅟₁ octave and ⅓ octave bandwidths being separated from one another in each case by an oblique stroke.

TABLE 1

| | Frequency (Hz) | | | | | |
|---|---|---|---|---|---|---|
| Test wall | 125 dB | 250 dB | 500 dB | 1 k dB | 2 k dB | 4 k dB |
| a | 22.1/22.5 | 34.2/35.0 | 41.1/41.2 | 50.2/50.4 | 44.0/41.6 | 51.2/55.7 |
| b | 30.8/32.3 | 48.2/49.2 | 57.4/57.5 | 59.9/60.3 | 60.3/59.0 | 62.9/65.3 |
| c | 46.3/45.8 | 58.7/59.5 | 61.0/60.3 | 63.3/64.2 | 68.9/68.7 | 75.2/75.8 |

It can be seen from FIG. 5 that the acoustic damping of the individual test walls "a" through "c" shows good conformity with the respective reference curve according to ISO standard 717-1(1996).

The panels are adhesively bonded with one another with an adhesive of very great adhesive strength and sealed with a hot-melt adhesive as used for e.g. the sealing of linoleum floor coverings.

The following non-limiting examples serve to illustrate the invention. It will be appreciated that variations in proportions and alternatives in elements of the components of the invention will be apparent to those skilled in the art and are within the scope of the present invention.

EXAMPLE 1

The behavior in fire of wall "b" fastened to a substructure was tested according to the standards NEN-6069(1997) and NEN-EN 1364-1, and it was ascertained that the thermal insulation showed an average temperature increase to 180° C. for the outer wall temperature after more than 39 minutes, and that the maximum temperature increase was reached after 28 minutes (NEN-EN 1364-1) and the outer wall temperature of 180° C. at 20° C. ambient temperature was reached after 29 minutes (NEN-6069(1997).

The flameproofness was also determined, and an essentially flameproof cotton play pressed against the heated wall did not catch fire until after 32 minutes.

After 37 minutes and more than 10 seconds, flames, which broke through a flameproof material screwed against the wall by means of an aluminum corner profile, became visible. If a Z-rail 7, 8 was used as the aluminum corner profile, no damage to the wall was ascertained at a temperature of 180° C., which acted for 30 minutes on the flameproof cotton ply fastened by the Z-rail on the outer side of a wall made from Trespa panels (HPL panels). The wall came away from its substructure after more than 39 minutes.

In addition to the walls indicated by way of example, still more embodiments exist, such as e.g. a wall with a cavity which is only half-filled or filled to two thirds of its depth with insulating material. The panel mounting system according to the invention admits a large number of modifications of the walls built using it. While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A panel mounting system for constructing a wall, comprising a grid of vertically upright C-profiles having lower and upper ends, which are pushed with their lower and upper ends into a horizontally extending U-profile, wherein bracket clips are fitted to outer sides of mutually opposite legs of each upright C-profile, wherein the bracket clips are arranged at the same height on each upright C-profile and are in engagement with rails, and wherein each bracket clip has a base plate with a rectangular outline, and wherein a claw bent off at a right angle is present at each corner of the base plate, and wherein panels are fastened to the rails.

2. The panel mounting system as claimed in claim 1, wherein the panels are fastened to the rails with screws, which screws have a length which is, at most,equal to the thickness of the panels.

3. The panel mounting system as claimed in claim 1, wherein each bracket clip has in the base plate a rectangular or square opening, in front of which opening a bracket is located, which bracket extends parallel to the base plate at a spacing of from about 1 mm to about 3 mm, the bracket forming, with the base plate, a gap having a width corresponding to the spacing, and, on its lower side, said bracket being connected to the base plate.

4. The panel mounting system as claimed in claim 3, wherein the bracket is congruent on three sides with the opening, and wherein a clear spacing of from about 2 m to about 4 mm exists between an upper edge of the bracket and an upper edge of the opening.

5. The panel mounting system as claimed in claim 4, wherein an upper portion of the bracket, together with the upper edge of the bracket, extends, bent off obliquely, away from the base plate.

6. The panel mounting system as claimed in claim 3, wherein a slot is present in the base plate below the bracket, through which slot the bracket clip can be fastened to the upright C-profile by means of a screw.

7. The panel mounting system as claimed in claim 3, wherein a slot is present above the bracket.

8. The panel mounting system as claimed in claim 3, wherein slots for fastening the bracket clip to the upright C-profile by means of screws are present below and above the bracket.

9. The panel mounting system as claimed in claim 3, wherein each of the rails has a double-angled profile which consists of a central profile portion and two profile portions projecting in opposite directions at right angles therefrom.

10. The panel mounting system as claimed in claim 9, wherein a lower profile portion of the rail is engaged in the gap between the bracket and the base plate of the bracket clip.

11. The panel mounting system as claimed in claim 9, wherein slots are present in an upper profile portion of the rail, through which slots panels are fastened invisibly via their rear sides by means of screws, and wherein a washer is located between the screw head of each screw and the upper profile portion of the rail.

12. The panel mounting system as claimed in claim 1, wherein the grid of vertically upright C-profiles is covered over its area on both sides with the panels and form a wall of predetermined wall thickness, and wherein any cavity present in the wall, between the panels, is acoustically insulated with insulating material.

13. The panel mounting system as claimed in claim 12 wherein the insulating material is selected from the group consisting of mineral wool and glass wool.

14. The panel mounting system as claimed in claim 12, wherein the acoustic insulation of the cavity as a function of an acoustic irradiation frequency ranging from about 125 Hz to about 4 kHz substantially conforms with EN-ISO standard 717-1(1996).

15. The panel mounting system as claimed in claim 12, wherein the insulation results in an outer wall temperature of about 180° C. at about 20° C. ambient temperature after more than about 39 minutes in the case of an averaged temperature increase, and after about 29 minutes in the case of a maximum temperature increase, and displays a behavior according to the standards NEN 6069(1997) and NEN-EN 1364-1.

16. The panel mounting system as claimed in claim 15, wherein the flameproofness is about 32 minutes when a cotton ply is pressed against the heated wall which is fastened to a substrate, wherein flames break through a flameproof material in contact with the heated wall after about 37 minutes and more than about 10 seconds, and wherein the heated all comes away from its substructure after about 39 minutes.

17. The panel mounting system as claimed in claim 12, wherein the wall, on an outer side of which a flameproof cotton ply is fastened by means of a Z-rail, and on which wall a temperature of about 180° C. acts for about 30 minutes, has no damage due to thermal action.

18. The panel mounting system as claimed in claim 1, wherein the grid of vertically upright C-profiles is covered over its area on both sides with the panels and forms a wall of predetermined wall thickness, and wherein any cavity present in the wall, between the panels, is free of insulating material.

19. The panel mounting system as claimed in claim 18, wherein the wall, on an outer side of which a flameproof cotton ply is fastened by means of a Z-rail, and on which wall a temperature of about 180° C. acts for about 30 minutes, has no damage due to thermal action.

* * * * *